United States Patent [19]

Jones et al.

[11] 4,101,413

[45] Jul. 18, 1978

[54] EXTRACTION OF COAL

[75] Inventors: William Derek Jones, Bredon, Nr. Tewkesbury; Geoffrey Michael Kimber, Cheltenham; James McLaren, Gotherington; David Watkin Price, Cheltenham, all of England

[73] Assignee: Coal Industry (Patents) Limited, London, England

[21] Appl. No.: 771,314

[22] Filed: Feb. 23, 1977

Related U.S. Application Data

[63] Continuation-in-part of Ser. No. 626,845, Oct. 29, 1975, abandoned.

[30] Foreign Application Priority Data

Nov. 8, 1974 [GB] United Kingdom ..... 48448/74

[51] Int. Cl.[2] ..... C10G 1/04

[52] U.S. Cl. ..... 208/8; 208/14; 208/131; 208/321; 260/674 SE

[58] Field of Search ..... 208/8, 14, 321; 260/674 SE

[56] References Cited

U.S. PATENT DOCUMENTS

| | | | |
|---|---|---|---|
| 2,664,390 | 12/1953 | Pevere et al. | 208/8 |
| 2,686,152 | 8/1954 | Franke | 208/8 |
| 3,451,925 | 6/1969 | Morris et al. | 208/326 |
| 3,607,716 | 9/1971 | Roach | 208/8 |
| 3,642,608 | 2/1972 | Roach et al. | 208/8 |

*Primary Examiner*—Herbert Levine

*Attorney, Agent, or Firm*—Stevens, Davis, Miller & Mosher

[57] ABSTRACT

Coal can be extracted with high boiling aromatic oils produced by extracting the aromatic constituents of a heavy petroleum material, e.g. a bitumen residue, using a selective solvent, mixing the extract with a low-boiling aromatic solvent, adding water and separating the aromatic-containing phase and recovering said aromatic constituents. The resulting coal extract is particularly suitable for the production of electrode coke.

8 Claims, No Drawings

EXTRACTION OF COAL

This application is a continuation-in-part of Ser. No. 626,845 filed Oct. 29, 1975 and now abandoned.

The present invention relates to the extraction of coal for the production of electrode coke from coal or for the hydrogenation of coal solution.

It is well known that high boiling aromatic solvents such as anthracene oil and other oils obtained from coal tar are generally good solvents for coal itself. On the other hand, petroleum solvents, because of their predominently aliphatic nature, do not readily act as solvents for coal.

In the solvent extraction of coal, particularly in the manufacture of electrode cokes, it has been found that a small proportion of the solvent cokes during the extraction itself and this may result in a steady and continued loss from the solvent in the system. This loss has hitherto been made up with fresh solvent, although the loss may be more or less balanced by the production of light species from the coal itself during extraction, especially if extraction is in the presence of hydrogen. This loss of solvent has been found to give rise to difficulties however, since the formation of coke from the solvent in the production of electrode coke has a deleterious affect on the resulting coke obtained from the coal extract.

In order to overcome this, it has been proposed to "refractorise" the solvent. This may be done, e.g. by refractionating or by passing the solvent through a coker. This ensures that any injurious coke formed as a result of coking of the solvent is removed therefrom prior to the use of the solvent in the extraction system. Such an additional coking operation is, of course, more costly, and about 5% of the solvent is lost as worthless coke. The Applicants have now found that this problem can be overcome and that an adequate solvent can be obtained by extracting heavy petroleum fractions with certain selected solvents.

The present invention, therefore, provides a process for obtaining solvent oils for use in the solvent extraction of coal, which process comprises extracting a heavy petroleum fraction or residue such as a tar distillate or residue with a solvent which selectively removes the aromatic components which are suitable for use as a solvent for coal from the fraction or residue, admixing the extract with a low-boiling aromatic solvent, removing the selective solvent and recovering said aromatic components for use as said solvent oil, and the invention also provides said solvent oil.

The selective solvents may be one or more of ethylene glycol, di-ethylene glycol, N-methyl pyrrolidone (NMP), sulpholane (thiacyclopentan-1,1-dioxide), N-formyl morpholine, α-butyrolactone and methyl isobutyl ketone.

The extraction can be carried out in either the liquid or the vapour phase, preferably at room temperature and ambient pressure. Suitable heavy petroleum fractions or residues are crude oil, petroleum oil distillate, cracker residual oils, bitumen or tar distillates, and "heavy" generally means a material boiling at or above 300° C at atmospheric pressure equivalent.

In the case of liquid phase extraction, the extract is separated from the raffinate, for example by decantation, and then admixed with a low-boiling aromatic solvent, for example benzene, toluene or xylene. The selective solvent is then removed, in the case of the preferred NMP solvent, by washing with water, which leaves an aromatic phase. It has been found that the addition of the low-boiling aromatic solvent greatly facilitates separation and recovery of the aromatic components despite the extra steps involved in addition of the low-boiling aromatic solvent and its removal to recover the aromatic components, e.g. by distillation. If the low-boiling aromatic solvent is not used, and the aromatic components are recovered from the extract by, e.g. the addition of water, there can be problems in achieving separation and recovery of the expensive NMP because of precipitation of fine viscous or solid droplets or particles of the aromatic component extract as soon as water washing is commenced.

The resulting aromatic components are used according to the present invention as a high boiling oil for coal extraction, and it is to be understood that these may be liquid or solid at ambient temperature. Their boiling temperatures broadly correspond to those of the heavy fraction or residue.

The invention also provides a process for the solvent extraction of coal, which process comprises extracting particulate coal with a high boiling liquid aromatic solvent oil which oil comprises a solvent oil according to the present invention, at a temperature above 350° C.

Further, coke can be prepared by the solvent extraction of coal, by subjecting particulate coal to extraction with a high boiling liquid aromatic solvent oil at a temperature above 350° C., separating the extract from the solids residue, subjecting the extract to delayed coking and recycling the solvent removed for further extraction wherein the solvent oil comprises a solvent oil according to the present invention.

The solvent oil according to the present invention may be used as a make up oil to compensate for losses or may form all or part of the initial solvent oil, preferably in admixture with anthracene oil.

It has been found that the solvent oils according to the invention are not as effective as anthracene oil as coal solvents but are, nevertheless, effective coal solvents in their own right. The use of the oils according to the invention is expected to eliminate the need to refractorise the solvents oils since either the oils do not coke substantially or alternatively, and more likely, the oils coke to produce an acceptable coke. Preferably not more than 10% of the solvent oil should coke and be incorporated in the product coke.

The following is a description by way of example only of methods of carrying the invention into effect. The low rank coal used was rank 702 on the Coal Classification System of the National Coal Board (1964), with a volatile content of 38.6% dry mineral matter free basis.

EXAMPLE

50gm of a vacuum bitumen, (B.pt. greater than 350° C at 5 mm Hg, i.e. greater than 550° C at atmospheric pressure) obtained from a North Sea crude oil, was heated under reflux with 200 gm N-methyl pyrrolidone for ½ hour until the bitumen was completely dissolved. The mixture was allowed to cool and 4 ml water was stirred in to produce two immisible layers. The upper layer was composed of the more paraffinic constituents of the bitumen and the lower extract layer contained the more aromatic constituents dissolved in the N-methyl pyrrolidone. The lower layer was separated and mixed with 125 ml toluene, and this mixture was washed three times with 250 ml $H_2O$ to remove the N-methyl pyrrolidone. Water was distilled off the N-methyl pyrrolidone washings to regenerate the solvent and the washed extract was distilled to yield 16 gm of an aromatic residue. A comparison of the coal solvent efficiency of this residue (extract) in comparison with the original bitumen can be seen from the following table:

| | Atomic H/C ratio | Solvent efficiency % |
|---|---|---|
| Original bitumen | 1.52 | 19 |
| Aromatic extract | 1.01 | 67 |

It will be noted that the solvent efficiency of the extract is approximately 3½ times that of the original bitumen. The solvent efficiency is the percentage of low rank coal substance on a dry mineral-matter free basis taken into solution by digestion of the coal for 1 hour at 400° C.

The solution of coal was filtered at 250° C on a glass-fibre filter cloth to remove undissolved coal and mineral matter, to give an ash content for the filtrate of considerably less than 1%. The filtrate is passed to a delayed coker and after processing in conventional manner yielded a green coke of the "needle" coke type, which could be used for the manufacture of carbon and graphite electrodes.

We claim:

1. A high boiling aromatic solvent oil for the solvent extraction of coal, produced by extracting a heavy petroleum material with a solvent which selectively removes the aromatic components which are suitable for use as a solvent for coal from the material, admixing the extract with an aromatic solvent selected from benzene, toluene and xylene, washing out with water the selective solvent from the admixture and recovering said aromatic components to form said solvent oil.

2. A solvent oil as claimed in claim 1, wherein the heavy petroleum material is selected from crude oil, petroleum oil distillate, tar distillate, tar residue, cracker residual oil and bitumen.

3. A solvent oil as claimed in claim 1, wherein the selective solvent is selected from one or more of ethylene glycol, di-ethylene glycol, N-methyl pyrrolidone, sulpholane, N-formyl morpholine, α-butyrolactone and methyl isobutyl ketone.

4. A solvent oil as claimed in claim 1, wherein the selective extraction is carried out in the liquid phase, at room temperature and ambient pressure.

5. A solvent oil as claimed in claim 4, wherein the selective solvent is N-methyl pyrrolidone.

6. A process for the production of a high boiling aromatic solvent oil for the solvent extraction of coal, which process comprises extracting a heavy petroleum material with a solvent which selectively removes the aromatic components which are suitable for use as a solvent for coal from the petroleum material, admixing the extract with an aromatic solvent selected from benzene, toluene and xylene, washing out with water the selective solvent from the admixture and recovering said aromatic components to form said solvent oil.

7. In the method of extracting coal comprising the step of contacting coal with a liquid solvent oil at elevated temperature, the improvement comprising using a solvent oil comprising the solvent oil of claim 1.

8. In the method of producing electrode coke from coal comprising the steps of extracting coal with a liquid solvent oil at elevated temperature, separating undissolved coal and mineral matter from the extract and coking the purified extract, the improvement comprising using a solvent oil comprising the solvent oil of claim 1.

* * * * *